US007505723B2

(12) United States Patent
Roof

(10) Patent No.: US 7,505,723 B2
(45) Date of Patent: Mar. 17, 2009

(54) AIR KNIFE SYSTEM WITH PRESSURE SENSOR

(75) Inventor: Bryan James Roof, Newark, NY (US)

(73) Assignee: Xerox Corporation, Norwalk, CT (US)

( * ) Notice: Subject to any disclaimer, the term of this patent is extended or adjusted under 35 U.S.C. 154(b) by 101 days.

(21) Appl. No.: 11/705,853

(22) Filed: Feb. 13, 2007

(65) Prior Publication Data

US 2008/0193176 A1 Aug. 14, 2008

(51) Int. Cl.
*G03G 15/20* (2006.01)

(52) U.S. Cl. ..... 399/323

(58) Field of Classification Search ..... 399/22, 399/323; 271/97

See application file for complete search history.

(56) References Cited

U.S. PATENT DOCUMENTS

| | | | | |
|---|---|---|---|---|
| 1,595,478 | A | 8/1926 | Minton | |
| 3,716,221 | A | 2/1973 | Gorka et al. | |
| 3,804,401 | A | 4/1974 | Stange | |
| 3,837,640 | A | 9/1974 | Norton et al. | |
| 3,955,813 | A * | 5/1976 | Edwards | 399/323 X |
| 3,981,085 | A | 9/1976 | Franko | |
| 4,040,118 | A | 8/1977 | Johnston | |
| 4,451,028 | A | 5/1984 | Holmes et al. | |
| 5,207,416 | A * | 5/1993 | Soler | 271/31 |
| 5,406,363 | A | 4/1995 | Siegel et al. | |
| 6,398,208 | B1 | 6/2002 | Yang et al. | |
| 6,490,428 | B1 | 12/2002 | Fromm et al. | |
| 6,669,187 | B1 | 12/2003 | Clark | |
| 6,726,200 | B2 * | 4/2004 | Gohl et al. | 271/97 |
| 6,994,340 | B2 | 2/2006 | Clark et al. | |
| 7,062,211 | B2 * | 6/2006 | Baba et al. | 399/323 |
| 7,137,302 | B2 | 11/2006 | Silverbrook et al. | |
| 2002/0047235 | A1 | 4/2002 | Allner et al. | |
| 2003/0205093 | A1 | 11/2003 | Clark | |
| 2003/0230843 | A1 | 12/2003 | Clark | |
| 2004/0120735 | A1 | 6/2004 | Baba et al. | |
| 2005/0156377 | A1 | 7/2005 | Jacobs | |

(Continued)

FOREIGN PATENT DOCUMENTS

| | | |
|---|---|---|
| EP | 1 288 736 A | 3/2003 |

(Continued)

OTHER PUBLICATIONS

Sensata Technologies, Sensor Products - 61CP Series Ceramic Capacitive Pressure Sensor, Stainless Steel, High Accuracy, Nov. 2, 2006, http://www.sensata.com/products/sensors/ipt-61cp.htm.*

(Continued)

*Primary Examiner*—Sandra L Brase
(74) *Attorney, Agent, or Firm*—Fay Sharpe LLP

(57) ABSTRACT

A fusing assembly includes a fuser member, such as a rotatable fuser roll which, during operation, contacts a sheet of print media to fuse a marking material to the sheet. A stripping apparatus applies gas to the sheet to assist in detaching the sheet from the fuser roll. The stripping apparatus includes a fluid pathway which connects an associated source of pressurized gas with at least one orifice adjacent the fuser roll. A pressure sensor senses a pressure of the gas in the fluid pathway intermediate the source and the at least one orifice during operation of the fuser roll.

22 Claims, 4 Drawing Sheets

U.S. PATENT DOCUMENTS

2006/0081056 A1 4/2006 Silverbrook et al.

FOREIGN PATENT DOCUMENTS

JP 60 256180 12/1985
JP 2005 128333 A 5/2005

OTHER PUBLICATIONS

Sensata Technologies, 60 CP Series Ceramic Capacitive Pressure Sensor, 5VDC Supply, Ratiometric Output, Aug. 2006, Sensata Technologies, Attleboro Massachusetts, http://www.sensata.com.*

Sensata Technologies, Sensor Products - 67CP Series Ceramic Capacitive Pressure Sensor, Brass, High Accuracy, Nov. 2, 2006, http://www.sensata.com/products/sensors/ipt-67cp.htm.*

* cited by examiner

AIR KNIFE SYSTEM WITH PRESSURE SENSOR

BACKGROUND

The exemplary embodiment relates to the imaging arts. It finds particular application in connection with an air knife stripping system for a fuser assembly and will be described with particular reference thereto.

In typical electrostatographic printing systems, for example, such as copy machines and laser beam printers, a marking engine includes a photoconductive insulating member, such as a photoreceptor belt or drum, which is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises toner particles adhering triboelectrically to carrier granules, which is often referred to simply as toner. The developed image is subsequently transferred to the print medium, such as a sheet of paper. The fusing of the toner image onto paper is generally accomplished by a fuser which applies heat to the toner with a heated fuser roll and application of pressure.

The molten toner has a tendency to stick to the elastomeric surface of the heated fuser roll, especially in the case of rolls with oiled or oil-releasing surfaces. In order to provide a uniform surface treatment by the fuser roll, it is desirable to provide reliable and consistent stripping of the print media sheets from the fusing surface of the roll. Various types of stripping systems have been developed. In an air knife stripping system, for example, jets of air are directed towards the print media to separate the print media from the fuser roll. The jets are emitted from small holes in an elongate surface which extends adjacent the fuser roll. The air jets have a tendency to lower the surface temperature of the fuser roll adjacent the jet, which can result in uneven gloss across the print media. To minimize the flow of air which is used in stripping the print media, and thus the cooling effect, systems have been developed which apply a short burst of air just as the leading edge of the print media reaches the air knife to initiate separation.

If the air knife system develops a leak, such as in the hoses supplying the air, poor stripping can occur, often requiring a service call to diagnose the problem.

INCORPORATION BY REFERENCE

The following references, the disclosures of which are incorporated by reference herein in their entireties, are mentioned.

U.S. Pat. No. 3,981,085, issued Sep. 21, 1976, entitled AIR STRIPPING DEVICE FOR ELASTOMERIC SURFACE, by Franko, discloses an air stripping device for stripping copy sheets from the surface of an elastomeric fuser roll surface in which copies are fused under heat and pressure. The air stripping device utilizes the deformation in the elastomeric surface resulting from the pressure to strip the copy sheets without directly contacting the fuser roll surface. One or more apertures are formed in the tip portion of the stripping device which are connected to a source of air pressure. The tip portion can be either flat or curved and is positioned at an acute angle relative to a tangential direction from which the copy sheet is stripped from the fuser roll surface.

U.S. Pat. No. 6,490,428, issued Dec. 3, 2002, entitled STRIPPER FINGERS AND ASSOCIATED MOUNTS FOR A FUSER IN A PRINTING APPARATUS, by Fromm, et al., discloses a fuser for xerographic printing in which stripper fingers remove the print sheet from a fuser roll. Each stripper finger is a thin member which is urged against the fuser roll with a spring force caused by deformation of the stripper finger against the roll.

U.S. Pat. No. 5,406,363, issued Apr. 11, 1995, entitled PREDICTIVE FUSER MISS-STRIP AVOIDANCE SYSTEM AND METHOD, by Siegel, et al. discloses an apparatus for minimizing fuser miss-strips from a heat and pressure fuser in an electrophotographic printing machine. A plurality of sensors are provided to determine the basis weight of the copy sheet, the density of the image being transferred to the copy sheet and fused thereon, the relative humidity of the machine environment, the process speed of the print engine, and the like. One action that may be taken to prevent a miss-strip is to increase the amount of release agent that is distributed to the fuser roll. Additionally, an air jet can be actuated to cause a jet of air to lift the leading edge of the fused sheet from the fuser roll, thus preventing a miss-strip.

BRIEF DESCRIPTION

In accordance with one aspect of the exemplary embodiment, a fusing assembly includes a fuser member which, during operation, contacts a sheet of print media to fuse a marking material to the sheet. A stripping apparatus applies gas to the sheet to assist in detaching the sheet from the fuser member. The stripping apparatus includes a fluid pathway which connects an associated source of pressurized gas with at least one orifice adjacent the fuser member. A pressure sensor senses a pressure of the gas in the fluid pathway intermediate the source and the at least one orifice during operation of the fuser member.

In another aspect, a method includes contacting a sheet of print media with a fuser member to fuse a marking material to the sheet. A gas is applied toward the sheet to assist in detaching the sheet from the fuser member. The method further includes sensing a pressure of the gas being applied to the sheet.

In another aspect, a fusing assembly includes a fuser and a stripping apparatus. The stripping apparatus includes a pneumatic airflow system including at least one valve which is selectively actuated to deliver a pulse of air to orifices positioned adjacent the fuser and a sensor in communication with the airflow system intermediate the at least one valve and the orifices. The sensor generates signals in response to pressure changes in the airflow system. A control system receives the signals from the sensor and determines whether a fault condition exists in the fusing assembly based on the signals.

DETAILED DESCRIPTION

Aspects of the exemplary embodiment relate to a stripping apparatus for stripping sheets from a fuser member, such as a heated roll of a fuser, to a fusing assembly incorporating the stripping apparatus, and to a method of printing.

The exemplary stripping apparatus includes an air knife and a pneumatic airflow system which supplies the air knife with pressurized air, or other suitable gas or gas mixture. It has been found that in a conventional air knife system, the air flow can vary over time, due, for example, to leaks, blockages, or the like in the pneumatic system. As a consequence, the airflow at the jets may diminish, leading to inadequate stripping of the paper from the fuser roll. This, in turn, can lead to image quality problems and paper jams. However, another factor in the quality of stripping is the wear on the fuser. If the fuser roll is already worn, increasing the airflow may thus not cure the problem, and in some cases, may exacerbate it. If the airflow is too high, differential gloss problems may occur due to cooling of the fuser. In the exemplary embodiment, a pressure sensor senses the air pressure at the knife. Based on the sensed pressure, a control system may implement a computer implemented process, such as a request for a service call or adjustments to the airflow system.

A "printing system," as used herein, can include any device for rendering an image on print media, such as a copier, printer, bookmaking machine, facsimile machine, or a multifunction machine. In general, a printing system may include at least one marking engine which includes components for rendering an image on print media and a fusing assembly for fixing the image to the print media. Exemplary marking engines include xerographic marking engines, although inkjet marking engines are also contemplated, such as those which employ heat-curable inks or "solid" inks (inks which are heated to a liquid state prior to marking and which solidify again on cooling).

"Print media" can be a usually flimsy physical sheet of paper, plastic, or other suitable physical print media substrate for images. An image generally may include information in electronic form which is to be rendered on the print media by the printing system and may include text, graphics, pictures, and the like. The operation of applying images to print media, for example, graphics, text, photographs, etc., is generally referred to herein as printing.

Figure 1:
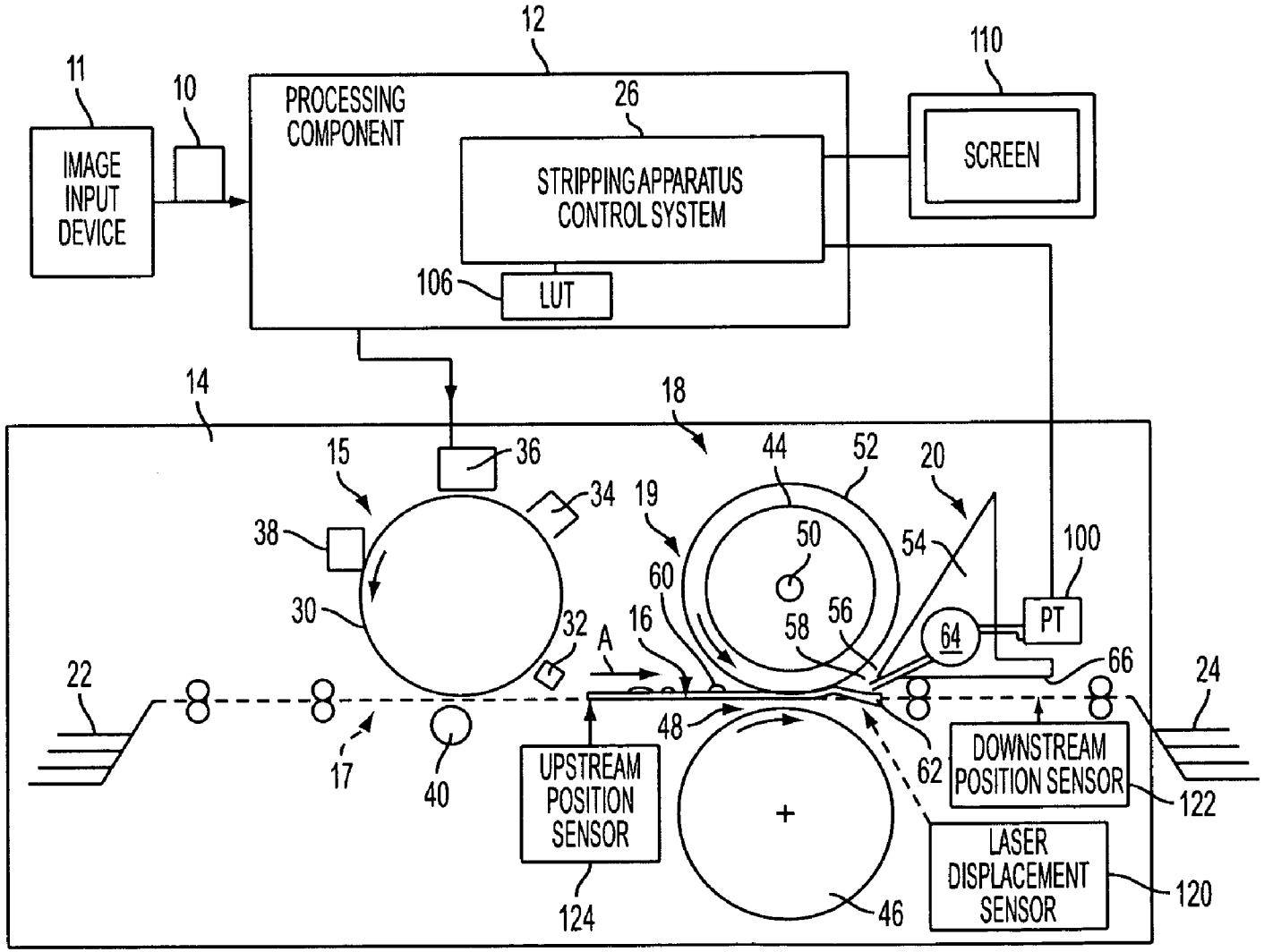
FIG. 1 is a schematic elevational view of a printing system comprising a stripping apparatus in accordance with one aspect of the exemplary embodiment.

With reference to FIG. 1, a schematic elevational view of electrophotographic (e.g., xerographic) printer, which incorporates the exemplary stripping apparatus, is shown. It will be appreciated that the stripping apparatus is equally well suited for use in a wide variety of printers, and is not limited in its application to the particular system shown herein. A document 10 to be printed, such as an electronic document or a scanned hardcopy, is transmitted as electrical signals from an image input device 11, such as a scanner, computer, or the like to a processing component 12 of the printing system (e.g., a digital front end). The processing component 12 converts the digital image into a form in which it can be rendered by a marking engine 14. The marking engine 14 includes an image applying component 15, which applies a toner image to sheets 16 of print media conveyed by a conveyor system 17 on a print media path in the direction of arrow A. The marked sheets 16, with a toner image thereon, are conveyed to a fuser assembly 18. The fuser assembly includes a fuser 19, which applies heat and pressure to fix the toner image more permanently to the sheet, and a stripping apparatus 20 which assists in removing the fused sheets from the fuser.

In the exemplary embodiment, the sheets 16 to be marked are fed from a feeder 22, upstream of the marking engine 14 and the marked sheets are delivered by the conveyor system to a finisher 24, downstream of the fuser 19, herein illustrated as paper trays. The stripping apparatus 20, and optionally other components of the printing system, including the image applying component 15, fuser 19, and conveyor system 17, may be under the control of a control system 26, which controls the operation of printing. It will be appreciated that FIG. 1 is a simplified representation of a printer and that additional components, such as inverters, additional marking engines, decurlers, and the like may be incorporated into the print media path.

As is known in the art, the image applying component 15 may include a variety of subcomponents employed in the creation of desired images by electrophotographic processes. In the case of a xerographic device, the image applying component of the marking engine typically includes a charge retentive surface, such as a rotating photoreceptor 30 in the form of a belt or drum. The images are created on a surface of the photoreceptor. Disposed at various points around the circumference of the photoreceptor 30 are xerographic subsystems which include a cleaning device generally indicated as 32, a charging station for each of the colors to be applied (one in the case of a monochrome printer, four in the case of a CMYK printer), such as a charging corotron 34, an exposure station 36, which forms a latent image on the photoreceptor, such as a raster output scanner, a developer unit 38, associated with each charging station for developing the latent image formed on the surface of the photoreceptor by applying a toner to obtain a toner image, and a transferring unit 40, such as a transfer corotron which transfers the toner image thus formed to the surface of a sheet of print media 16.

The fuser 19 receives the marked print media with the toner thereon and applies heat and pressure to fuse the image to the sheet. The illustrated fuser 19 includes a pair of rotating rolls 44, 46, which together define a nip 48 through which the sheet with the toner image thereon passes. At least one of the rolls 44 is heated, for example, by means of an internal heater 50, such as a lamp. The other roll 46 applies pressure at the nip 48 and in one embodiment, may also be heated. The fuser roll 44 has an elastomeric surface 52 to which a thin coating of a release oil, such as silicone oil, may be applied. The surface 52 may be provided by a layer of Teflon™ or similar material, which is supported on a cylindrical metal core. While particular reference is made to a rotating fuser roll, other fuser members, such as belts, are also contemplated.

The exemplary stripping 20 apparatus includes an air knife 54 which is positioned downstream of the nip 48. A stripping edge 56 of the air knife 54 is positioned closely adjacent to, but without touching, the fuser roll surface 52. Spaced along the edge (i.e., in the cross-process direction) are a plurality of orifices 58 which direct air jets toward the toner side 60 of a leading edge 62 of the sheet to detach the leading edge of the sheet from the fuser roll 44. The orifices 58 are fed with air from a plenum 64 within the air knife 54. An underside 66 of the air knife may provide a guiding surface for the sheet.

Figure 2:
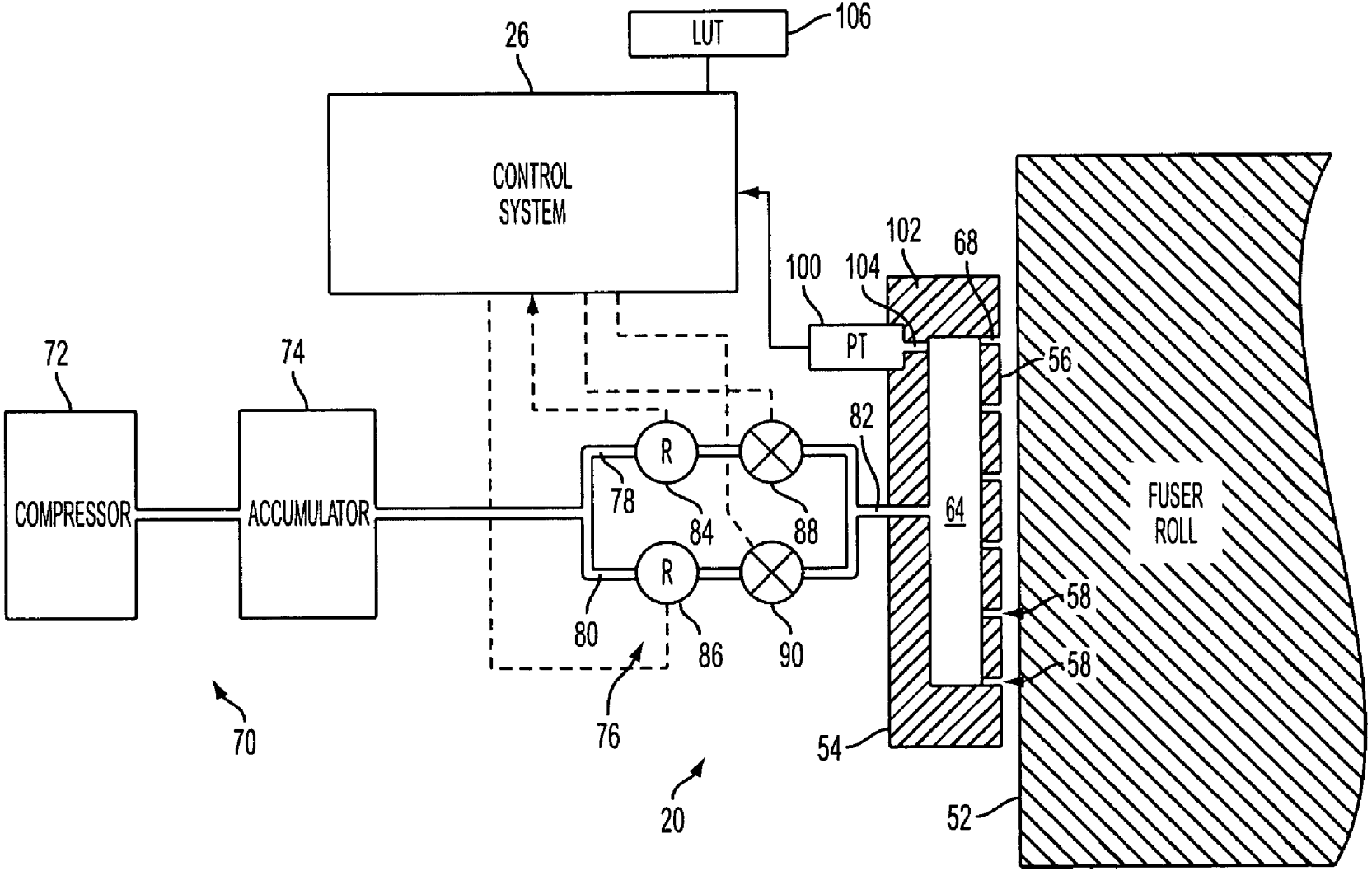
FIG. 2 is a plan view of a fusing assembly comprising a first embodiment of the stripping apparatus of FIG. 1.

As best shown in FIG. 2, the plenum 64 has its longest dimension arranged in the cross-process direction, with the orifices 58 communicating with the plenum via individual air supply tubes 68 formed in a wall of the air knife which defines the edge 56. While multiple collinear orifices 58 feeding air in generally the same orientation from the plenum 64 are shown, it is also contemplated that other arrangements of orifices may be provided, or even that a single laterally extending orifice may be used.

A pneumatic system 70 supplies air under positive pressure to the plenum 66. In the illustrated embodiment, the pneumatic system 70 includes a source 72 of pressurized air, such as a compressor. The pressurized air may be stored temporarily in an accumulator 74 in communication with the compressor 72. The plenum 64 forms a part of a fluid pathway 76, which carries the air from the accumulator 74 to the air knife orifices 58. The fluid pathway 76, in the embodiment illustrated in FIG. 2, includes two branch pathways 78, 80, which split the air stream into two streams, however, in other embodiments, a single pathway, or more than two branch pathways, may be employed. The two branch pathways 78, 80 rejoin to form an inlet pathway 82, closer to the plenum 64. Each branch pathway 78,80 includes a pressure regulator 84, 86 and a valve 88, 90, downstream of the respective regulator. The first regulator 84 may be set at the same or a higher pressure than the second regulator 86. The regulators 84, 86 maintain a pressure differential between the portion of the respective branch 78, 80 upstream of the regulator and the portion downstream. The regulators 84, 86 may include automated actuators which are actuated by the control system 26, in order to change the pressure differential.

The valves 88, 90 are automatically actuable valves, such as solenoid valves. The solenoid valves 88, 90 are configured for opening and closing briefly, to provide a short burst of air, or pulse. In the illustrated embodiment, the valves 88, 90 are under the control of the control system 26.

Figure 4:
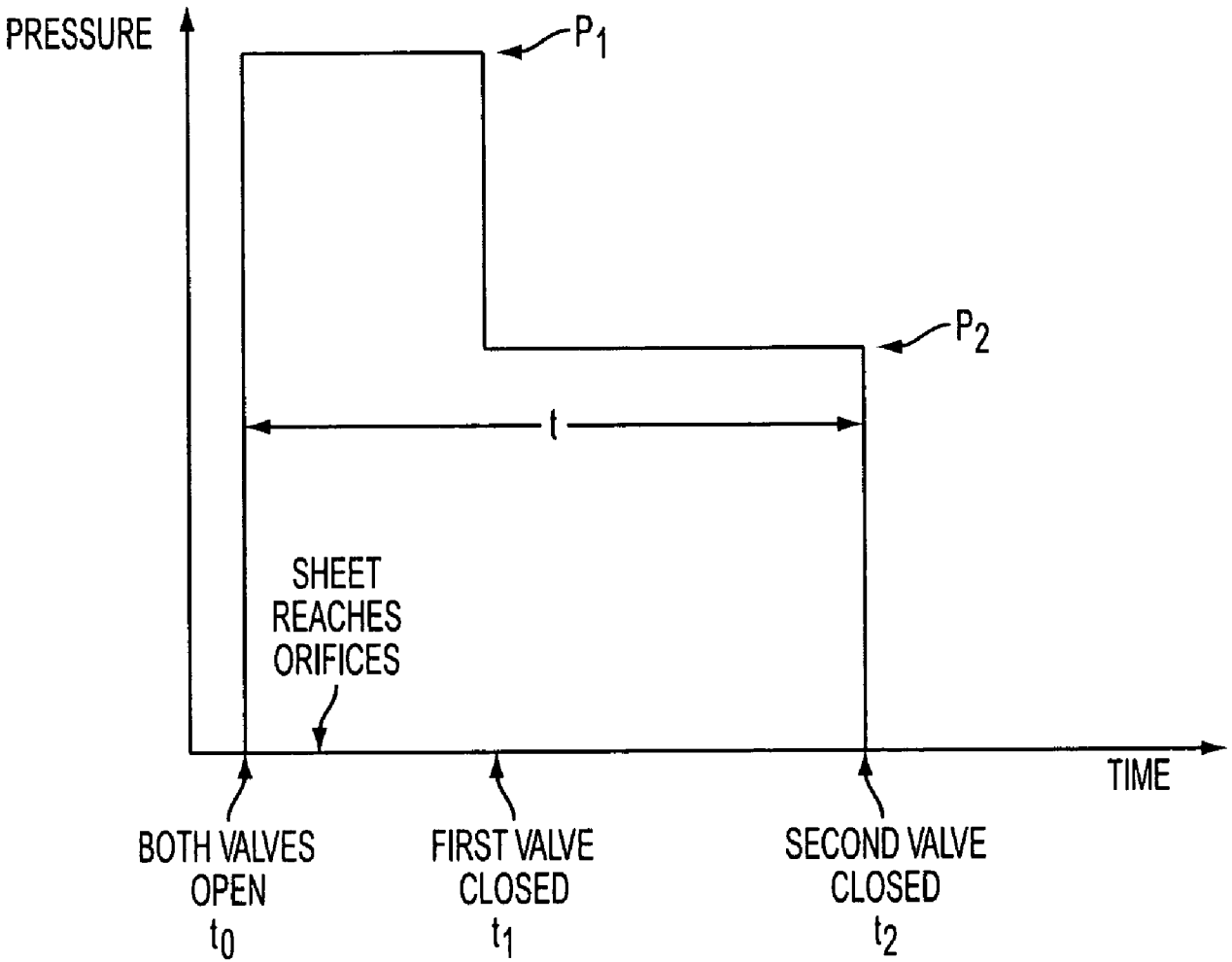
FIG. 4 illustrates changes in pressure during a pulse of air.

As illustrated in FIG. 4, the airflow follows a cycle which is repeated periodically, with each approaching sheet. At the time a leading edge 62 of a sheet is approaching the orifices 58, a burst of air is delivered by opening both valves 88, 90. However, the higher pressure regulator 84, in line with valve 88 is solely responsible for the amount of flow. At this time, the pressure in the plenum may be at a first pressure $P_1$. After a short period of time, corresponding to the passage of the first inch or so of paper from the lead edge passing the orifices, valve 88 may be closed. Valve 90 remains open to provide a flow of air which is lower than the initial flow. In this way, the amount of air applied from the orifices 58 is rapidly reduced without additional delays and temporal flow disturbances related to opening valve 90. After the sheet either passes the orifices 58 completely, or is captured by the next downstream conveyance device, valve 90 also closed, thereby rapidly reducing the pressure to approximately atmospheric.

The amount of air applied from the orifices 58 is rapidly reduced, first to an intermediate level $P_2$, then to zero (approximately atmospheric), as the weight of the fused sheet 16 exiting the nip 48 takes over the role of stripping the sheet from the fuser roll 44. The cycle is repeated for each sheet of print media passing through the nip 48.

By way of example, for a 140 ppm printing system, valves 88, 90 may be opened at time $t_0$, which may be about 20 milliseconds before the lead edge of a sheet reaches the orifices. Pressure $P_1$ may be maintained until time $t_1$, which may be about 40 milliseconds after lead edge passes the orifices. Thereafter, pressure $P_2$ may be maintained until $t_2$, which may be about 200 milliseconds after the lead edge passes the orifices.

The fluid pathways 78, 80, 82, etc., which feed the plenum 64 with air, may be defined by air hoses which are sealed at connections with the valves 88, 90, regulators 84, 86 and each other by o-rings and the like. Some or all of the air hoses may be formed from rubber or other flexible material. Over time, the rubber may perish or the seals or valves may wear leading to leakage from the fluid lines downstream of the regulators 84, 86. As a result, the airflow at the orifices 58 in each cycle may change over time. The stripping action of the air knife 52 may thus be compromised. For example, the leading edge 62 of the sheet may be retained on the fuser roll 44 downstream of the nip area, or a portion of the sheet upstream of the leading edge may be reattached to the fuser roll 44 in a process known as retack. Either of these events may lead to differential gloss streaks in the process direction of the toner image. In some instances, due to wear of the valve, or the like, the airflow at the orifices 58 may be higher than that planned, leading to cross-process direction variation in gloss due to differential cooling.

In the exemplary embodiment, a pressure sensor (PT) 100 is positioned to sense the pressure of the air in the fluid pathway 76 downstream of all the valves 88, 90, i.e., between the valves 88, 90 and the orifices 58. More specifically, the sensor 100 measures a property, such as a diaphragm movement, which changes in response to pressure changes, and outputs a signal, such as a current signal, indicative of the change in the property. In the illustrated embodiment, the pressure sensor senses the pressure in the plenum 64. In particular, the pressure sensor 100 is tapped into a wall 102 of the air knife at an upstream side of the plenum 64 to provide a fluid passage 104 between the plenum 64 and the pressure sensor 100. Since the pressure may be lowest adjacent the orifice. 58 furthest from the inlet passage 82, the pressure transducer may be located adjacent this orifice. Alternatively, the pressure sensor 100 may be positioned to measure the pressure in inlet portion 82 or elsewhere downstream of the valves 88, 90. In one embodiment, a plurality of pressure sensors spaced between the valves 88, 90 and the orifices 58 may be provided.

The pressure sensor 100 may be a fast response pressure sensor, such as a pressure transducer. In order to detect changes in pressure during the course of a pressure cycle, the pressure transducer 100 may have a response time which is shorter than the time t between opening and closing of the valves. In one embodiment, the transducer has a response time of less than about 20 milliseconds, e.g., the response time is about 10 milliseconds or less. In one embodiment, the response time of the pressure sensor 100 is less than the actuation time of the valves 88, 90. For example, the valves may take 15 milliseconds or less to actuate. The response time of the pressure sensor 100 may be about 100 microseconds, or less, e.g., about 20 microseconds, or less. Exemplary pressure sensors are fast response pressure transducers, such as silicon-on-sapphire transducers, as described, for example, in U.S. Pat. No. 6,424,017, the disclosure of which is incorporated herein by reference, in its entirety. Pressure transducers of this type may have a response time in the microsecond or nanosecond range and are available from Sensonetics, Inc. One example is the SEN-300. Capacitative transducers may also be used in this application. An exemplary capacitative pressure transducer 100 is a Sensata 61CP Series or 67CP Series ceramic capacitative pressure sensor which has a maximum response time of 10 milliseconds.

The pressure sensor 100 provides signals representative of the sensed pressure to the control system 26. For example, current signals representative of pressure changes are output to control system 26.

In operation, as a leading edge 62 of a sheet passes through the nip 48, the pneumatic airflow system supplies air to the orifices 58 by selective opening and closing of valves 88, 90. The air is emitted towards the leading edge to provide a bearing force which separates the sheet 16 from the fuser roll. Meanwhile, the sensor measures pressure within the plenum and provides a control signal to the control system. If the control system detects a fault condition based on the detected pressure, the control system may implement the computer implemented process.

In one embodiment, the control system 26 determines whether the sensed pressure is within a predetermined acceptable range. For example, the control system may access a look up table (LUT) 106 which stores the predetermined values. Since the pressures sensed by the sensor 100 may change cyclically, as the pressure changes in the plenum 64 throughout a cycle, the control system 26 may compare sensed pressure measurements at various times throughout a cycle to determine whether the sensed pressures are each within a predetermined acceptable range. Alternatively, the control system 26 may compute an average pressure over a cycle, or over multiple cycles, and compared the result to the stored values. In yet another embodiment, the control system may evaluate whether changes in sensed pressure over a period of time, such as over multiple cycles, are representative of a failure condition, such as a slowly developing leak which, over time, may result in insufficient flow at the orifices 58.

Since the pressure in the plenum 64 is related to the flow rate at the orifices, in one embodiment, the control system 26 determines a flow rate based on the sensed pressures. Based on a computed flow rate, the control system may determine that a fault condition exists.

If the control system 26 determines that the pressure detected by the sensor is outside the predetermined range, e.g., above it or below it, or otherwise does not meet predetermined criteria, the control system may initiate a computer implemented process. In one embodiment, the computer implemented process includes providing a notification or otherwise reporting the status of the stripping apparatus 20. The notification may be provided to an operator, for example, via a display screen 110.

In another embodiment, the notification may be sent to a remote service center, e.g., via a local area network or internet connection. In the case of a leak in the airflow system, incorrect pressure may lead to lower flow, which in turn would lead to stripping failures and jams. By having the sensor 100 in line, a service flag can be sent to diagnose the issue easier and before a catastrophic failure. In the case of a gradual failure, where an imminent catastrophic failure is determined to be unlikely, the remote service center may schedule a check of the stripping system by an engineer to coincide with another service call and thereby avoid an additional visit.

In another embodiment, the measurement may be used to compensate for leaks and component wear that cause the pressure to drop at the air knife plenum 64. For example, the control system 26 may use the sensed pressures in a feedback control loop whereby one or more modifications may be made to the pneumatic system 70 to compensate for the sensed pressure changes. For example, the control system 26 may control the valves 88, 90 and/or pressure regulators 84, 86. Using the exemplary pressure transducer 100, the timing of the pressure valve actuations may be controlled in order to produce reliable stripping over a wide range of media without creating undue temperature differentials on the fuser roll 44 which may lead to gloss non-uniformities on the prints. In the case of a pressure which is below/above an acceptable value, the control system 26 may adjust one or both of the regulators 84, 86 to increase the pressure. Or the control system 26 may adjust the actuation of the valves 88, 90 to change the timing, e.g., adjusting the length of time which a valve is open. The adjustment may be based on a look up table 106 accessible to the control system. Alternatively, further pressure measurements may be used to check that the adjustments have brought the sensed pressure measurements within the desired range.

In another embodiment, feedback from the pressure sensor 100 is used to control the timing of the valve 88, 90 actuation. The orifices 58 do not reach the pressure at the valves instantaneously, due to settling in the hoses etc. The pressure sensor 100 can be used to determine the delay time for the pressure at the orifices to reach the desired value. The control system 26 may adjust the timing of the valve(s) to coincide with the arrival of the sheet leading edge based on the determination.

As will be appreciated, the response time of the control system 26 may not be sufficient to make adjustments which affect the current sheet, but may initiate the adjustments for subsequent sheets.

In one embodiment, the control system 26 makes adjustments based on the pressure sensor 100 signals and on the output of one or more second sensors 120, 122, 124. The second sensor may sense a paper property, an image property, or a property of the printing system. For example, a sensor 120 (FIG. 1) is positioned to sense a property of the sheet. The property may relate to bending of the sheet. A suitable sensor for this purpose is a laser displacement sensor which includes an LED light source and a detector which detects light which is reflected from the sheet, e.g., from an underside of the sheet. If the sensor 120 detects that the leading edge is further from the sensor than normal, this suggests it is adhered to the downstream side of the fuser roll more than it should be and thus a miss-strip may result. The control system 26 may adjust the valves/regulators to increase the airflow. In this embodiment, the pressure sensor 100 may be used to set limits on the adjustments which are made. By keeping the pressure within a predetermined range, excessive cooling of the fuser roll may be avoided.

In another embodiment, the second sensor 122 may be a downstream position sensor. Sheets which do not strip properly may take longer than normal to reach the position sensor 122. Thus, the second sensor 122 may be used to detect a fault condition, such as a miss-strip. The pressure sensor 100 may be used by the control system 26 to determine whether the fault condition is due to fuser wear or improper pressure. As the surface of the fuser roll wears, stripping performance may degrade (due to changes in surface roughness). If the pressure is detected as being within an acceptable range, this may indicate a fuser failure rather than a failure of the stripping system, and the control system 26 may send a notification for a fuser check or replacement. If a retack condition is determined to result from an air flow which is too low, the control system 26 may actuate the second (and or first) regulator 86 so that the intermediate pressure P2 is higher.

In one embodiment, the second sensor may include an upstream paper position sensor 124. The upstream position sensor 124 may be positioned to detect the leading edge 62 of a sheet approaching the fuser. A closed loop control between the upstream paper position sensor 124, the pressure sensor 100, and the air valve(s) 88, 90 can be formed in order to minimize the air flow on-time before the paper arrives at the orifices 58, yet making sure the flow is stable. This reduces premature blowing on the fuser roll which affects temperature profiles and hence causes differential gloss. In this embodiment, the control system 26 may receive time related paper position information from the upstream sensor 124 and time related sensed pressure measurements from the in-line pressure sensor 100. The timing of the pressure measurements can be used to determine the delay time between the valve actuation and the emission of the air from the orifices. The control system 26 then adjusts the valve 84, 86 actuation time so that the air bursts coincide with the arrival of the sheet at the air knife, rather than too soon, which could lead to unnecessary cooling of the fuser roll.

Other sensors (not shown) may be used to detect a paper jam or paper wrap. Where paper jams or paper wrap are detected, the control system 26 may use the pressure sensor information to evaluate whether this is due to inadequate or excess airflow and implement corrective action before catastrophic failures occur.

In yet another embodiment, the second sensor may include a glossmeter (not shown, in the paper path downstream of the fuser nip to determine the gloss of the fused toner image. Gloss measurements from the glossmeter may be sent to the control system 26. If the glossmeter measurements are indicative of a variation in the gloss in cross process or process direction, these may be used in combination with readings from the pressure sensor and/or sheet position sensor 122 to characterize the source of the failure as being fuser wear or airflow-related and/or to determine corrective action, such as adjustment in the timing of the valves or adjusting the pressure by adjusting the regulators.

The measurements from one or more second sensors may thus be used in combination with the pressure sensor to identify a fault condition. The information may be used by the control system 26 to determine whether stripping failures result primarily from fuser wear or from airflow changes, or from a combination of factors, and appropriate corrective action taken.

Other sensors suited to use as the second sensor include those described in U.S. Pat. No. 5,406,363, incorporated by reference and may include for example, one or more of a sheet basis weight sensor, a toner coverage sensor, a relative humidity sensor, a process speed sensor, and the like. Measurements from the second sensor 96 may be used, in combination with measurements from the pressure sensor to determine appropriate valve and/or regulator settings which take into account both the plenum pressure and the sheet property.

Figure 3:
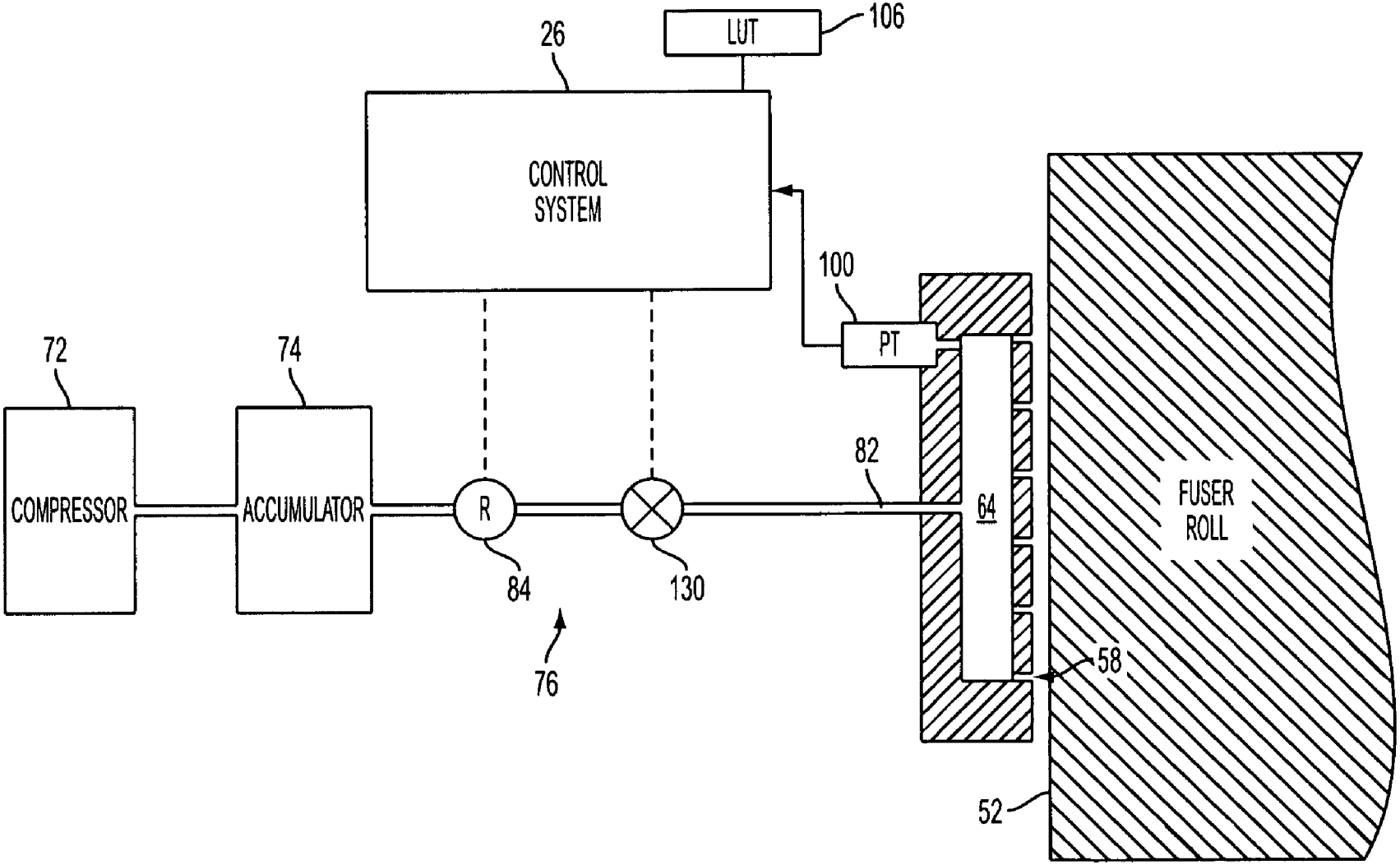
FIG. 3 is a plan view of a fusing assembly comprising a second embodiment of the stripping apparatus of FIG. 1.

With reference now to FIG. 3, another embodiment of a pneumatic airflow system is shown. The system of FIG. 3 may be configured analogously to that of FIG. 2, except as otherwise noted. The system shown includes a single pressure regulator 84 and a single solenoid air valve 130 in an unbranched fluid pathway 76. The valve 130 is adjustable to provide more than one open position, such as a fully open position and an intermediate, partially opened position between the fully open and closed positions. For example, the valve 130 may be set to fully open ($P_1$) for the lead edge of the sheet and partially open ($P_2$) for some distance after the lead edge passes, but before the next sheet enters the nip. The valve 130 may be a solenoid valve which is pulse width modulated. In such a valve, the spring force which biases the valve plunger to the closed position is balanced against the solenoid coil, which pulls the plunger up, by fluttering the current to the coil on and off at a particular frequency. By adjusting the delay time (the time between each current pulse to the coil), the valve closure can be maintained in a selected position between its open and closed positions. For example, in each pressure cycle, the valve is fully open for a first period of time and partially closed for a second period of time. In this way, the pressure in the plenum 64 may be stepped in a manner similar to that shown in FIG. 4 without the need for a second regulator and a second valve.

In this embodiment, the pressure measurements sensed by the pressure sensor 100 may be used for feedback control of the valve 130. Other uses for the pressure sensor 100 in this embodiment are as described for the embodiment of FIG. 2.

While the printing system has been described with respect to a single control system 26, it is to be appreciated that the control system may include a plurality of control systems which control separate aspects of the printing system and that the control system need not be in one location but may be distributed throughout the printing system or in operative communication therewith.

The exemplary control system 26 may execute instructions stored in associated memory for performing the methods described herein and may be implemented as a general purpose computer, dedicated computing device, or the like.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A fusing assembly comprising:

a fuser member which, during operation, contacts a sheet of print media to fuse a marking material to the sheet; and a stripping apparatus which applies gas to the sheet to assist in detaching the sheet from the fuser member, the stripping apparatus including a fluid pathway which connects an associated source of pressurized gas with at least one orifice adjacent the fuser member, and a pressure sensor which senses a pressure of the gas in the fluid pathway intermediate the source and the at least one orifice during operation of the fuser member.

2. The fusing assembly of claim 1, further comprising a control system which receives pressure-related signals from the pressure sensor.

3. The fusing assembly of claim 2, wherein the control system determines whether a fault condition exists in the fusing assembly based at least in part on the pressure-related signals.

4. The fusing assembly of claim 2, wherein the control system determines whether the pressure of the gas is outside a predetermined range based on the pressure-related signals.

5. The fusing assembly of claim 4, wherein the control system determines an adjustment to the stripping apparatus based on the pressure-related signals.

6. The fusing assembly of claim 2, wherein the control system is configured for controlling actuation of at least one of a valve and a pressure regulator in the fluid pathway based on the pressure-related signals.

7. The fusing assembly of claim 6, wherein the at least one valve comprises a solenoid valve which is selectively actuated to provide a pulse of gas to the at least one orifice.

8. The fusing assembly of claim 2, wherein the control system is configured for issuing a notification of a fault condition based on the pressure-related signals.

9. The fusing assembly of claim 1, wherein the fluid pathway includes at least one selectively actuatable valve and the pressure sensor is intermediate the at least one selectively actuatable valve and the orifices.

10. The fusing assembly of claim 1, wherein the fuser member comprises a rotatable roll.

11. The fusing assembly of claim 1, wherein the pressure sensor comprises a pressure transducer.

12. A xerographic printing system comprising the fusing assembly of claim 1.

13. A fusing assembly comprising:

a fuser member which, during operation, contacts a sheet of print media to fuse a marking material to the sheet;

a stripping apparatus which applies gas to the sheet to assist in detaching the sheet from the fuser member, the stripping apparatus including:

a fluid pathway which connects an associated source of pressurized gas with at least one orifice adjacent the fuser member, and a pressure sensor which senses a pressure of the gas in the fluid pathway intermediate the source and the at least one orifice during operation of the fuser member;

a second sensor; and a control system which receives pressure-related signals from the pressure sensor, the control system determining a fault condition or an adjustment to the stripping apparatus based on information from the first and second sensors.

14. A fusing assembly comprising:

a fuser member which, during operation, contacts a sheet of print media to fuse a marking material to the sheet; and a stripping apparatus which applies gas to the sheet to assist in detaching the sheet from the fuser member, the stripping apparatus including:

a plenum, adjacent the fuser member, which is open to atmosphere through a plurality of orifices which communicate with the plenum, a fluid pathway which connects an associated source of pressurized gas with the plenum, and a pressure sensor which senses a pressure of the gas in the plenum during operation of the fuser member.

15. A method comprising:

contacting a sheet of print media with a fuser member to fuse a marking material to the sheet; and applying pulses of gas toward the sheet to assist in detaching the sheet from the fuser member; and sensing a pressure of the pulsed gas being applied toward the sheet.

16. The method of claim 15, wherein the applying of the gas includes, for each of a plurality of the sheets, applying gas at a first pressure for a first period of time and applying the gas at a second pressure for a second period of time and wherein the sensing of the pressure includes sensing the pressure of the gas in at least one of the first and second periods of time.

17. The method of claim 15, further comprising determining whether a fault condition exists based on the sensed pressure.

18. The method of claim 17, wherein when a fault condition is determined to exist, automatically initiating a computer implemented process.

19. The method of claim 15, further comprising adjusting at least one of a valve and a regulator to modify a flow rate of the gas if the sensed pressure is outside a selected range.

20. The method of claim 15, wherein the applying of the gas includes applying a pulse of gas to a leading edge of the sheet and wherein the sensing of the pressure of the gas includes sensing the pressure at least once during the pulse.

21. The method of claim 20, wherein the applying a pulse includes opening and closing at least one valve in a fluid supply pathway carrying the pressurized gas and wherein the method further includes, based on the at least one sensed pressure, modifying at least one of:

a length of time that the valve is in an open position during a pulse of gas;

a position of the valve between open and closed positions during the pulse; and a time at which the valve is opened.

22. A fusing assembly comprising a fuser and a stripping apparatus, the stripping apparatus comprising:

a pneumatic airflow system including at least one valve which is selectively actuated to deliver a pulse of air to orifices positioned adjacent the fuser;

a sensor in communication with the airflow system intermediate the at least one valve and the orifices, the sensor generating signals in response to pressure changes in the airflow system; and a control system which receives the signals from the sensor and determines whether a fault condition exists in the fusing assembly based on the signal.

* * * * *